United States Patent [19]

Biolik et al.

[11] 4,351,057

[45] Sep. 21, 1982

[54] ELECTRIC INSTALLATION FOR HEATING OF MOLTEN METALS AND/OR SALTS AND SOLUTIONS

[75] Inventors: Felicjan Biolik; Adam Łukasik; Zagmunt Morys; Stanisław Walawender, all of Katowice; Szczepan Galazka, Mysłowice, all of Poland

[73] Assignee: Biuro Projektow Przemyslu Metali Niezelaznych "BIPROMET", Katowice, Poland

[21] Appl. No.: 157,829

[22] Filed: Jun. 9, 1980

[51] Int. Cl.[3] ..... H05B 3/60; H05B 3/03

[52] U.S. Cl. ..... 373/117; 373/120; 373/121; 373/125

[58] Field of Search ..... 13/18 R, 18 A, 23, 25, 13/6; 219/437, 316; 204/219, 250

[56] References Cited

U.S. PATENT DOCUMENTS

| | | | |
|---|---|---|---|
| 2,783,288 | 2/1957 | Acquarone | 13/23 |
| 3,049,576 | 8/1962 | Upton | 13/23 |
| 3,578,580 | 5/1971 | Schmidt-Hatting et al. | 204/250 X |
| 3,924,672 | 12/1975 | Paton | 13/18 R |
| 4,039,737 | 8/1977 | Kemper | 13/18 A |
| 4,158,743 | 6/1979 | Biolik et al. | 13/25 |

*Primary Examiner*—Roy N. Envall, Jr.

[57] ABSTRACT

An electric installation for heating molten metals and/or salts, as well as for heating solutions with direct heating of the baths by means of resistance heating elements partly dipped in the bath being heated.

The heat necessary for heating the charge is generated in a heating element partly immersed in the bath being heated, in contact materials being in contact with the heating elements as well as in the bath being heated. Electric potential difference is applied by the electrodes and current supply means to the contact materials in contact with a first surface of the heating element and to the bath being heated which is in contact with a second surface of the heating element, the contact materials being included in the electric circuit of the heating element.

26 Claims, 21 Drawing Figures

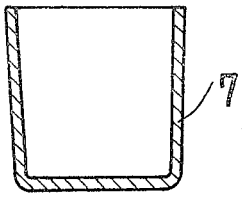
FIG. 2
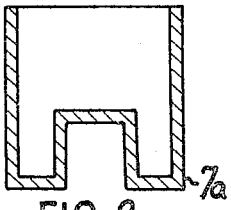
FIG. 3
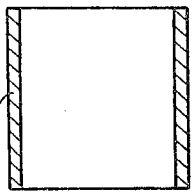
FIG. 4
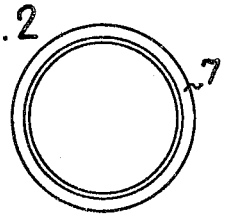
FIG. 2a
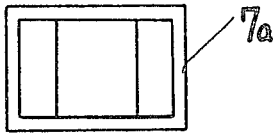
FIG. 3a
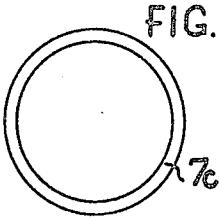
FIG. 4a
FIG. 5a
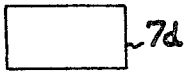
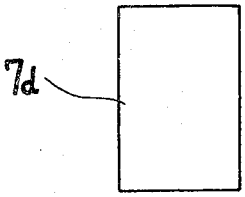
FIG. 5
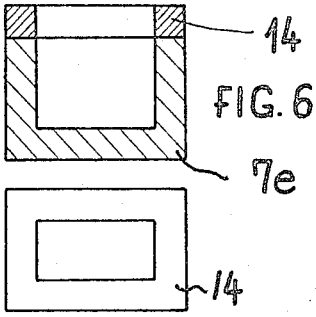
FIG. 6
FIG. 6a
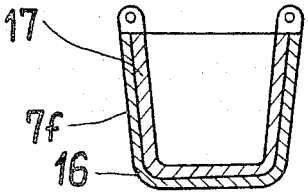
FIG. 7
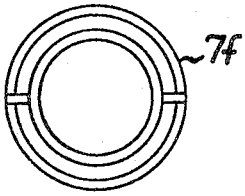
FIG. 7a
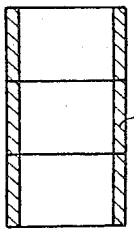
FIG. 8
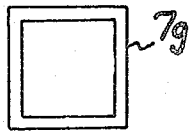
FIG. 8a

ELECTRIC INSTALLATION FOR HEATING OF MOLTEN METALS AND/OR SALTS AND SOLUTIONS

BACKGROUND OF THE INVENTION

The present invention relates an electric installation for heating molten metals and/or salts, as well as solutions by direct heating of the bath by means of resistance heating elements dipped in the bath. The electric heating installations so far known, wherein the heat generated in the heating elements is transmitted directly to the bath, are provided with heating elements as, for instance in the Polish Pat. No. 81,320, in the shape of one or several partitions located preferably parallel to the electrodes situated either in the bottom or in the walls of the melting tank. The partitions are built preferably of a uniform plate of ceramic material and divide the melting bath into two or more parts, or they are built in the walls or bottom of the melting tank and at least their one surface is in contact with the metallic bath, or as in the Polish Pat. No. 106,380 said partitions are provided with heating elements shaped as a vessel situated in the furnace chamber and the current supply units are situated inside the vessel shaped as an electrode, preferably a graphite one and the molten metal adheres to the bottom and walls of the heating element.

The drawbacks of known electric heating installations is their limited range of application, mainly they are used for non-ferrous metals, a relatively low power carrying capacity and a short service-life of the heating elements as a result of the destructive effect of thermal stresses arising in heating elements, a poor utilization of heating elements surfaces due the variable submersion depth of the heating elements, short life of electrodes and current supplies to heating elements caused by direct influence of the charge and atmosphere in the installation as well as a very difficult start-up of the equipment from the cold state as a result of a rather poor contact of the heating elements with the solid charge.

The aim of this invention is to have the above mentioned drawbacks eliminated or their effects reduced.

This aim has been achieved, among others by the application of a suitable shape and manufacturing method of heating elements, by series or series-parallel and also double series connections of contact materials into the heating element circuit, and by increasing the electrically active area of heating elements in using contact materials.

The purpose of the invention is the heating of molten metals and/or salts and solutions as well as melting and maintaining metals, salts and solutions in molten state and also their superheating.

SUMMARY OF THE INVENTION

The substance of the invention consists in that the heat required for heating a charge by means of at least one resistance heating element shaped as a vessel or partition, arises under the effect of the current flowing through the heating element, partly immersed in the heated bath, in contact materials being in contact with the eating elements and in the heated bath, at the same time electric potential difference is applied by electrodes and current supply means to contact materials being in contact with one surface of heating element and to the heated bath, being in contact with the other surface of the heating element and the contact materials are included into the circuit of the heating element.

The heating element can also consist of two vessels partly dipped in the bath being heated and one of these vessels being situated inside the other one and the space between both vessels, as well as the inside of the first vessel being partly filled with contact materials. The heating element can also be made in the shape of a solid or solids located in a limiting ring, preferably made of a ceramic material, the said solid or solids being partly dipped in the bath being heated and covered with a layer of contact material, preferably molten salt of a density not exceeding the density of the bath being heated and the heating element. The said heating element can also be made in the shape of a solid or solids situated in a limiting ring, preferably made of a ceramic material, the said solid or solids being partly dipped in the bath being heated and covered with a layer of contact material, preferably the molten metal separated from the level of the bath being heated by another layer of contact material, preferably molten salt.

A heating element in the shape of a tube can also be partly dipped in the bath being heated, one end of the tube being tightly fixed in the bottom of the chamber of the heated bath of a preferably tiltable arrangement.

The heating element can also have the shape of a double vessel consisting of two single heating elements, connected in series partly dipped in the heated bath and mounted at the top edge of the wall parting the bath being heated into two parts insulated galvanically from each other, the electric potential difference being applied to the heated bath on both sides of the partition wall.

The heating element can also be made in the shape of a tube and partly dipped in the bath being heated and an electrode mounted inside the said bath acts simultaneously as the contact materials.

The heating elements are preferably made of sintered materials of a resistivity at working temperature below 100 Ωm preferably within the limits from 0.001 to 2.5 Ωm and a porosity from 0 up to 30 percent. The electrodes are made of materials of a resistivity at least 10 (ten) times lower than the resistivity of the material of the heating elements.

Contact materials are current conducting materials with a resistivity below 200 Ωm. The heating elements in the shape of a vessel or partitions have an arbitrary cross section, and the height of the said heating elements is up to 2 meters, the wall thickness of the vessels or partitions up to 0.2 meters, and the electrically active area up to 2 sq.m.

The heating elements are made of a homogenous material as a single shape or several shapes permanently combined together. The faces of the said heating elements can also be partly covered with a material resistant to the chemical action of the charge, or the contact materials, the advantageous thickness of the said covering layer being within 0.1 up to 3 mm.

The heating elements can also be saturated with substances diminishing the porosity of the material of the heating elements.

The heating element having the shape of a vessel can also freely float in the bath being heated.

The heating element can also float in the bath being heated with a forced immersion caused by a weight. The external weight of the heating element can also be adapted for introduction of protective gas to the inside of the said heating element. It can also be provided with an auxiliary resistance heater mounted in direct proximity to the edges of the heating elements projecting from the bath and included in the electric circuit of the heating element.

The heating element can also be immersed in the bath being heated and fastened to a movable suspension enabling (permitting) a steady immersion depth of the heating elements at the varying level of the bath being heated.

The heating element can also be partly dipped in the bath being heated and permanently fastened to the structure of the heating installation, preferably a tiltable one.

Electrodes connected by means of current supply means to one pole of a current source are immersed in the heated bath whereas electrodes connected by means of current supply means to the second pole of the current source are partly dipped in contact materials in the heating element.

The supply voltage of the heating elements is adjustable and the bath being heated is earthed. Starting the heating installation from cold state and using the charge in solid state is performed either by an additional heater kept operating until the first portion of the charge is melted, or by means of the main heating elements supported on the solid charge, while the surfaces of the heating elements are in contact with the charge and electrode via some additional contact materials, preferably having a pasty consistence.

Advantages of the invention, besides others, are the following: a wide range of application, particularly for heating molten metals, salts and solutions as well as melting the metals and salts, a large load-carrying capacity of the heating elements due to application in the given process engineering of the adequately shaped and suitably manufactured heating elements, the correct immersion of heating elements in the heated bath, the series-parallel or series connection of contact materials with the circuit of the heating element, heating of edges of the heating elements protruding out of the heated bath, materials suitable for the given process engineering used for manufacturing the heating elements and contact materials, increased electrically active area of the heating elements by placing one heating element inside another heating element and adequate current source for the used process, long service-life of the electrodes and current supply means as a result of using adequate materials or protective atmospheres, elimination of upper current supply means in result of application of heating elements in the shape of a double vessel, startability of the installation from its cold state due to improvement of contacts of the heating elements with the solid charge by additional contact materials preferably of a paste-like consistence and simple design and operation of installation as a result of applying many methods of installing the heating elements, electrodes and current supply means, easy replacement of heating elements without switching off the installation operations.

BRIEF DESCRIPTION OF THE DRAWING

The subject of the invention is presented in exemplary embodiments in the enclosed figures, in which

FIGS. 2 and 2*a* are respectively a cross-section and top view of the heat generating body of a heating element used in the installation of FIG. 1;

FIGS. 3 and 3*a* are respectively a cross-section and top view of another heating element having an enlarged active surface area;

FIGS. 4 and 4*a* respectively are a cross-section and top view of a tube-shaped heating element;

FIGS. 5 and 5*a* are respectively a side and top view of a heating element having the shape of a prism;

FIGS. 6 and 6*a* respectively are a cross-section and top view of a heating element in the shape of a receptacle made of two parts of different electrical conductivities sintered together;

FIGS. 7 and 7*a* are respectively a cross-section and top view of another receptacle-shaped heating element made from two bodies of different electrical conductivities;

FIGS. 8 and 8*a* respectively are a cross-section and top view of a tubular heating element made by sintering together three parts of different electrical conductivities;

DETAILED DESCRIPTION OF PREFERRED EMBODIMENTS

Figure 1:
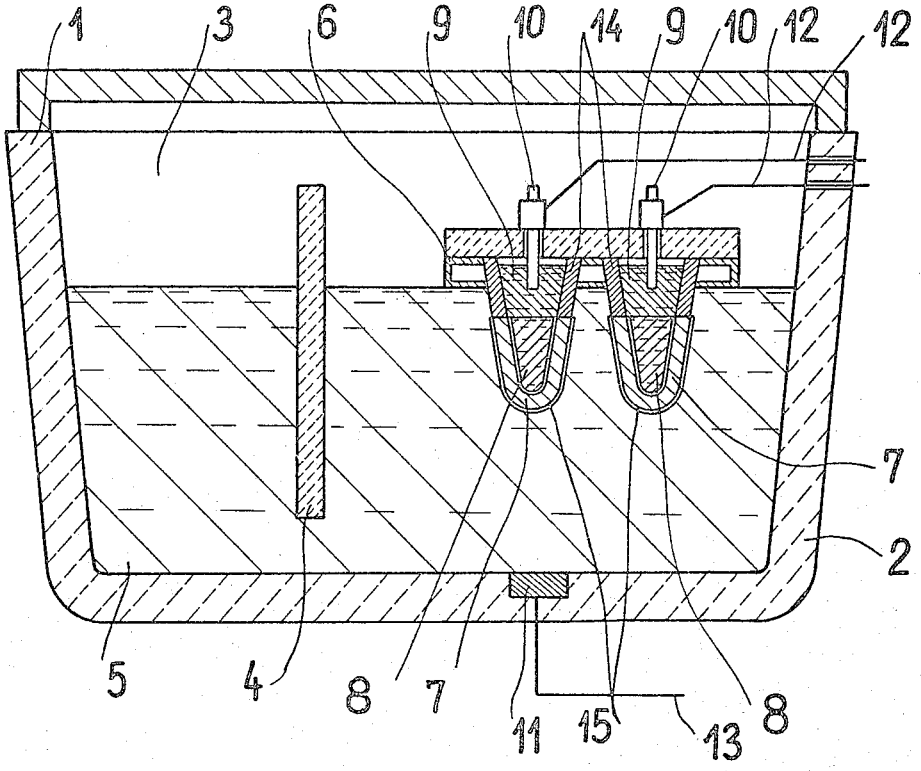
FIG. 1 is a cross-sectional view of an installation according to the invention.

An example of embodiment of the equipment according to the invention, shown in FIG. 1, consists of ceramic walls 1 which, together with a bottom 2, form a chamber 3 of the installation. Wall 4 parts chamber 3 into a settling chamber and melting chamber. Chamber 3 is partly filled with metal 5 in molten state.

In metal 5 there are two heating elements 7 suspended on a float 6 having the shape of vessels partly filled with molten metal 8 and molten salt 9, serving as contact materials between an iron electrode 10 dipped in the molten salt 9 and one surface of the heating element 7. In the bottom 2 of the chamber 3 there is a graphite electrode 11 installed in such a way that one of its ends is connected to the structure of installation whereas the second one is in contact with the second surface of the heating element 7.

Electric current flows from electrode 10 through the molten salt 9, molten metal 8, walls of the heating element 7, and metal 5 to the electrode 11 under the influence of the voltage differences applied via a current supplier to electrode 10 and current supplier 13 to electrode 11.

A ring 14 made of aluminosilicate is mounted by means of sintering to the upper edges of the heating element 7. The heating element 7 is made of a nitrided silicon carbide. The outer and inner faces of the heating element 7 are covered with a thin layer 15 of a carbon paste. Metals 8 and 5 are aluminum, salt 9 is a mixture of calcium chloride and sodium chloride and the float 6 is made of light kaolin.

The installation according to the above described embodiment of the invention operates in the following way. Upon preheating of chamber 3 of the installation by means of an additional heater and filling the chamber partly with molten metal 5, heating elements 7 filled with molten metal 8 and molten salt 9 are immersed in the metal bath 5, installing simultaneously electrodes 10 and current suppliers 12. To a current supply means 12 and 13 is applied a three-phase alternating voltage and the R-phase voltage is applied to the first heating element 7, whereas the S-phase is applied to the second heating element 7.

As a result of the applied voltages, the electric current flowing through the walls of the heating element 7 and the layer of molten salt 9 generates heat transmitted to the metal bath 5. A solid charge to be melted is introduced to the said metal bath 5.

On completion of the metal melting process and its settling the installation is emptied partly by being tilted, or by being pumped or, finally, by tapping the metal through a tap hole situated either in the bottom, or in the wall of the chamber 3.

The start-up of the installation from cold state in case of a solid charge is performed by means of an additional heater operating until the first batch of charge is molten, or by means of heating elements 7, placed on the solid charge, the surfaces of heating elements 7 hereby adhere to the charge 5 and metal 8 by means of a carbon paste, electrode 10 contacts metal 8 and electrode 11 the charge 5.

FIGS. 2, 2*a* to 8, 8*a* illustrate the shapes and manufacture of various heating elements 7*a* to 7*g* of the installation according to the invention. FIGS. 2*a* to 5*a* are drawings representing the heating elements 7*a* to 7*d* as made of a homogenous material as an uniform shape. More specifically FIGS. 2 and 2*a* show a vessel-shaped heating element 7 made of homogenous material but with edges rounded up for avoiding thermal stresses and cracks.

FIGS. 3 and 3*a* show a vessel-shaped heating element 7*a* with enlarged heat transfer surface area.

FIGS. 4 and 4*a* show a tube-shape heating element 7*c* which can be firmly fixed to the bottom of the furnace chamber.

FIGS. 5 and 5*a* show a freely floating prismatic heating element 7*d* to be assembled.

FIGS. 6, 6*a* show a heating element 7*a* to the top edge of which a ring 14 made of aluminosilicate is fixed by sintering.

FIG. 7 shows the heating element 7*f* made of two parts 16 and 17 connected together by sintering, wherein the electric conductivity of the material of part 17 is lower than that of part 16.

FIGS. 8 and 8*a* illustrates a heating element 7*g* made from three shapes connected together by sintering.

In FIGS. 9 to 16 are presented various locations of the heating elements 7–7*i* of the installation, according to this invention.

Figure 9:
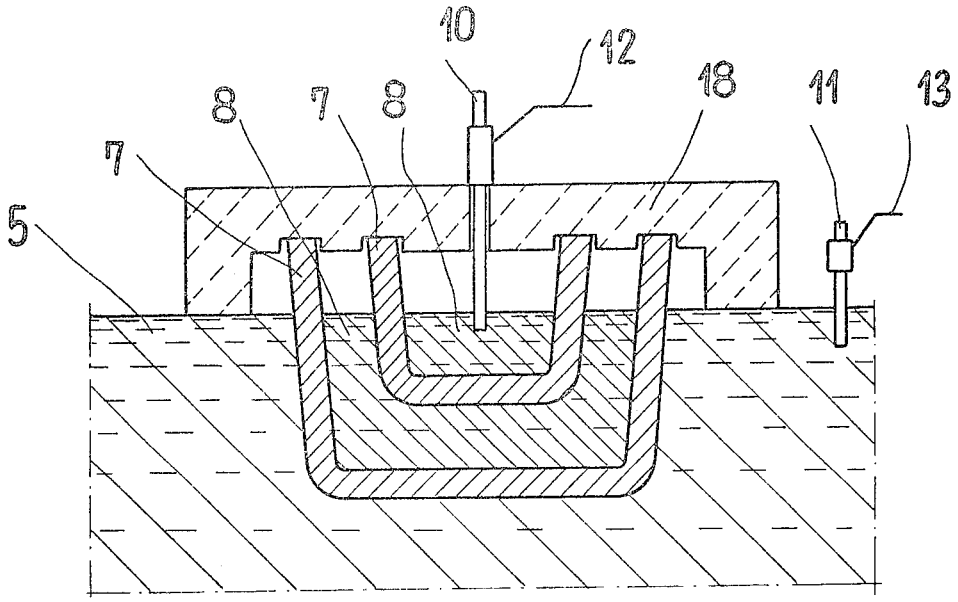
FIG. 9 presents a cross-section of a heating element consisting of two vessel-shaped heating bodies one floating inside the other.

FIG. 9 shows two heating elements in the shape of a vessel floating due to a forced immersion caused by the weight 18, in metal 5 whereby one heating element 7 is placed in the second heating element 7 and the space between the heating elements 7 and the inside of the first heating element 7 is filled partly with metal 8. Metals 8 and 5 are zinc, electrodes 10 and 11 are made of graphite, weight 18 is made of a cement-fireclay material reinforced with iron bars and the heating elements 7 are made of nitrided silicon carbide.

Figure 10:
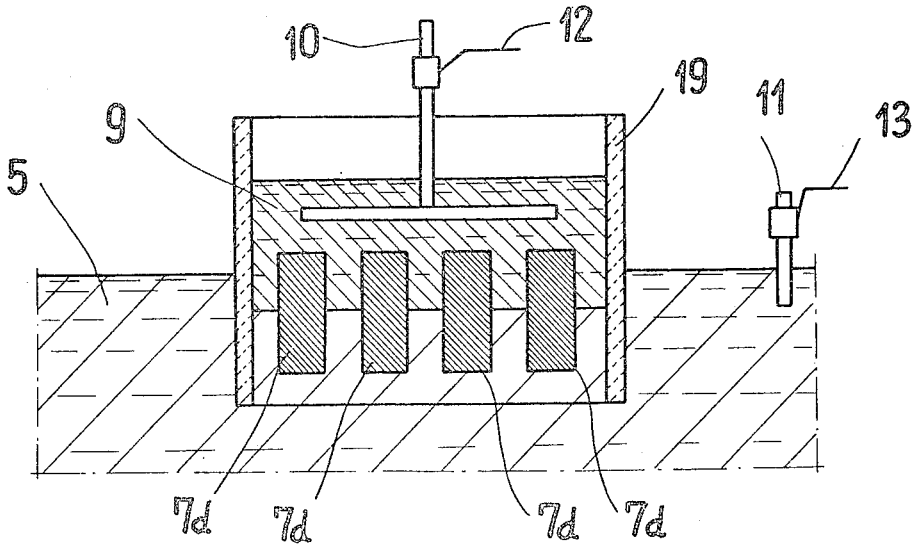
FIG. 10 is a cross-section through a heating element formed of prismatic bodies floating within a limiting ring.

FIG. 10 shows four heating elements 7*d* in the form of a rectangular prism floating freely in metal 5 in a limited ring 19 covered with a layer of melted salt 9.

In consequence of a potential difference applied to the electrodes 10 and 11, the electric current flows from the electrode 10 parallel through the salt 9 and heating elements 7 to metal 5, and then to electrode 11. Metal 5 is a zinc and aluminum alloy, salt 9 is a mixture of calcium chloride and sodium chloride, electrode 10 is made of iron, electrode 11 is made of graphite, limiting ring 19 is made of fireclay, whereas the heating element 7*d* is made of nitrided silicon carbide.

The start-up of the installation from cold state is carried out by means of the heating elements 7*d* placed on the solid charge 5, the surfaces of the heating elements 7*d* adhere to the charge 5 and to electrode 10 by means of a carbon paste and the electrode 11 being in contact with the charge 5. During the start-up nitrogen is metered to the chamber 3 in order to protect the carbon paste against oxidation. After the charge 5 is molten contact material 9 is introduced into the limiting ring 19.

Figure 11:
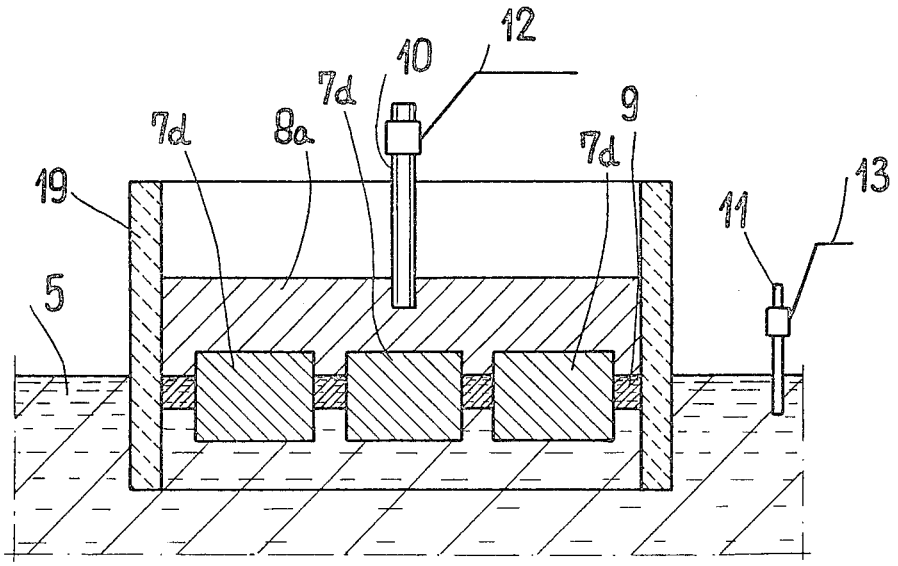
FIG. 11 shows another arrangement of a heating element, consisting of prismatic bodies floating within a limiting ring.

FIG. 11 shows three heating elements 7*d*, each in the shape of a rectangular prism floating freely in metal 5 in the limiting ring 19. The heating elements 7*d* are covered with a layer of metal 8*a* separated from the free surface of metal 5 by a layer of molten salt 9 whereby the layer of the molten salt 9 is below the upper edges of the heating elements 7*d*.

In consequence of a potential difference applied to electrodes 10 and 11, electric current flows from electrode 10 through metal 8*a* parallel through salt 9 and heating elements 7*d* to metal 5, and therefrom to electrode 11. Metal 9 is an aluminum alloy, metal 5 is aluminum bronze, electrodes 10 and 11 are made of graphite coated with silicon carbide brought from gaseous phase, salt 9 is a mixture of sodium carbonate and sodium chloride, heating elements 7*d* are made of nitrided silicon carbide and the limiting ring 19 is made of a fireclay material.

Figure 12:
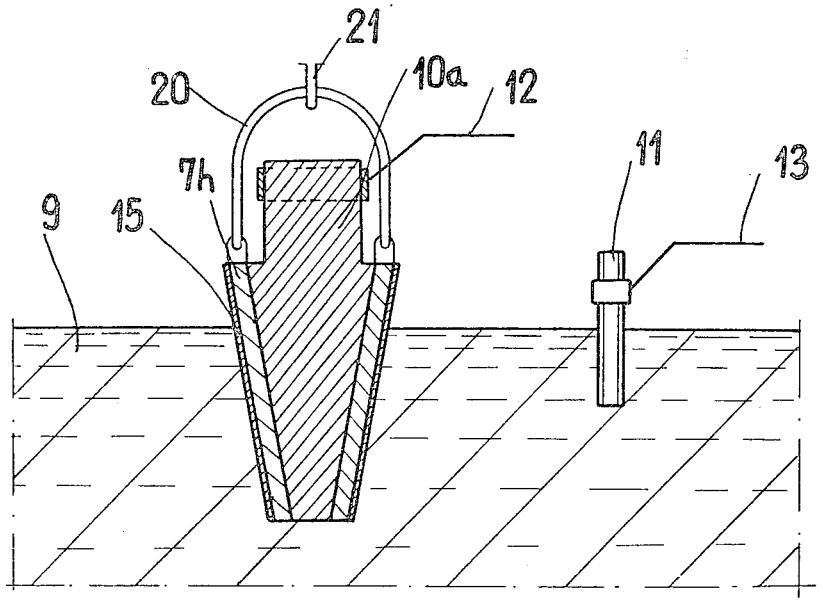
FIG. 12 shows a cross-section of a tapered tube-shaped heating element suspended in the bath.

FIG. 12 shows a heating element 7*h* in the shape of a tapered tube movably suspended in the molten salt 9 by means of a grip 20 and cable 21 to the body of the installation so as to obtain a steady draft of the heating element 7 independently of the level of the salt bath 9. Electrode 10*a* connected to the current supply means 12 is in direct contact with one surface of the said heating element 7*h*. The tapered portion of the said electrode 10*a* serves simultaneously as contact material. The outer surface of the heating element 7*h* is coated with a thin layer of material 15.

As a result of the potential difference applied to the electrodes 10 and 11, the electric current flows from electrode 10 parallel to the heating element 7*h* and electrode 10 to salt 9 and therefrom to electrode 11. Salt 9 is a mixture of barium chloride and calcium chloride, material 15 is silicon carbide obtained from the gaseous phase, electrode 10 is made of sintered silicon carbide by reaction and electrode 11 is made of graphite coated with a thin layer of silicon carbide obtained from gaseous phase, the grip 20 and cable 21 are made of alloy steel, and the heating element 7 is made of nitrided silicon carbide.

Figure 13:
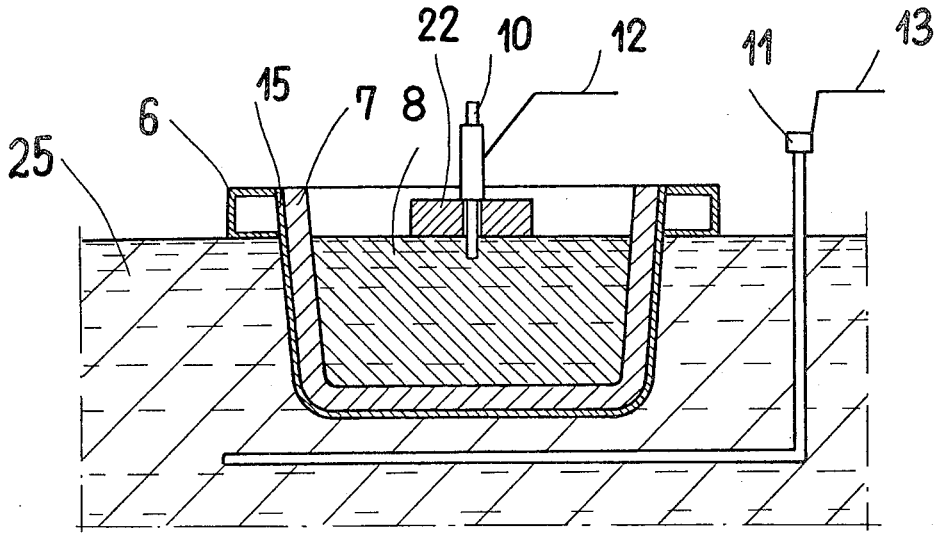
FIG. 13 illustrates a receptacle-shaped heating element for heating solutions.

FIG. 13 presents heating element 7 in the shape of a vessel immersed in a water solution 25 of sulphuric acid and suspended on a float 6, the inside of the said heating element 7 being filled with metal 8. The external faces of the said heating element 7 are coated with a thin layer of material 15. Metal 8 is a Wood alloy, the float 6 is made of polyethylene, electrode 10 is made of graphite, electrode 11 is made of acid resistant steel float 22 is made of graphite, and the heating element 7 is made of sintered material on graphite base, layer 15 is silicon carbide obtained from gaseous phase.

Figure 14:
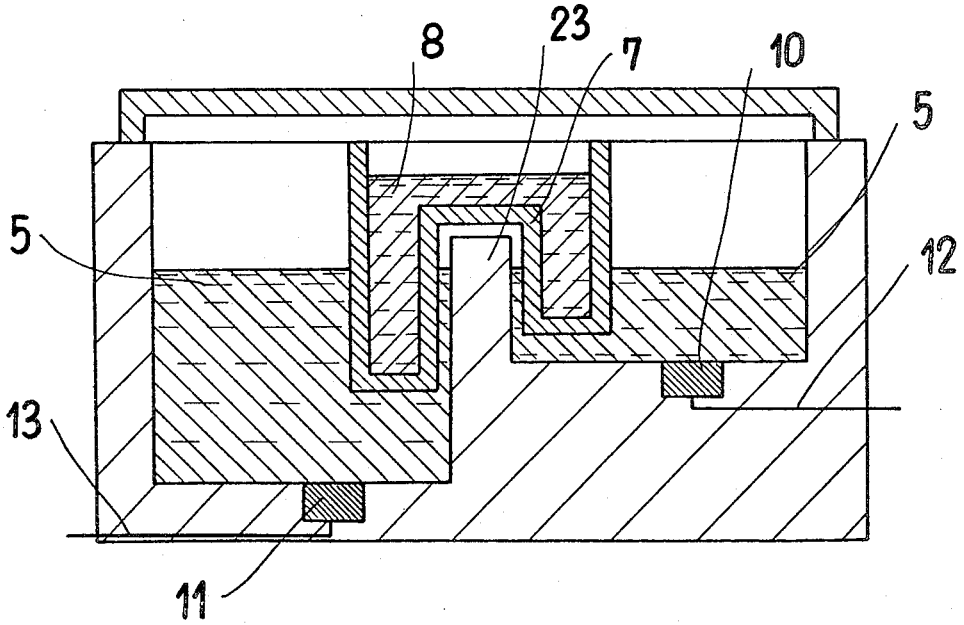
FIG. 14 presents a furnace heating installation using a heating element, the furnace chamber being partitioned in two electrically separated parts.

FIG. 14 shows a heating element *7i* in the shape of double vessel partly dipped in metal 5 and partly filled with metal 8; the wall 23 divides the bath 5 into two equal parts insulated from each other. Electric current flows from electrode 10 through metal 5, walls of the heating element *7i* and metal 5 to electrode 11 under the effect of the potential difference applied to the electrode 10 connected to the current supply means 12 and to electrode 11 connected by the current supply means 13. The heating element *7i* is made of a sintered material on the basis of zirconium oxide, metals 8 and 5 are molten steel, electrodes 10 and 11 are made of graphite and wall 23 is made of a material on the basis of corundum.

We claim:

1. Electric installation for direct heating of a charge, such as a bath of metals and/or salts in melted state and solutions, comprising: at least one heating element for heating the charge, each heating element being in the form of a vessel or partition made of at least two parts of different physico-chemical properties, said parts being firmly joined to each other and having a portion immersed in the heated bath, contact materials being in contact with a first surface of said heating element, a first electrode dipped at least partially into said contact materials, means for applying an electric potential difference between said electrode and a second electrode located at least partially in the bath, an electric circuit connected to said heating element and including current supply means to said electrodes, said bath being in contact with a second surface of said heating element, said contact materials being included in said electric circuit of said heating element.

2. Electric installation according to claim 1, wherein the heating element comprises two vessels and is partly immersed in the heated bath, one vessel being located inside the other and the space between both vessels, as well as the inside of said one vessel being partly filled with said contact materials.

3. Electric installation according to claim 1, wherein said heating element is in the shape of solid block situated in a limiting ring and is partly immersed in the heated bath, said solid block being covered with a layer of contact material of a density smaller than that of the heated bath and the heating element.

4. Electric installation according to claim 1, wherein said heating element is in the shape of a solid block situated in a limiting ring and is partly immersed in the heated bath and covered with a layer of contact material separated from the free surface of the bath by another layer of contact material.

5. Electric installation according to claim 1, wherein said heating element is in the shape of a tube partly immersed in the heated bath and wherein one end of said tube is tightly fixed to the bottom of a chamber confining the heated bath.

6. Electric installation according to claim 1, wherein said heating element is in the shape of a double vessel forming a series connection of two individual heating elements, is partly immersed in the heated bath, and is mounted to the upper edge of a wall dividing the heated bath into two parts isolated from each other, said electric potential difference applying means being operatively connected to the heated bath on both sides of the dividing wall.

7. Electric installation according to claim 1, wherein the heating element is in the shape of a tube partly immersed in the heated bath, one of said electrodes being located inside said tube and serving as contact materials.

8. Electric installation according to claim 1, wherein the heating element is made of a material of a resistivity at working temperature of the heated bath below 100 Ωm.

9. Electric installation according to claim 1, wherein said electrodes are made of materials of a resistivity at least ten times lower than the resistivity of the material of which said heating element is made.

10. Electric installation according to claim 1, wherein said contact materials are current conducting materials of a resistivity below 200 Ωm.

11. Electric installation according to claim 1, wherein said heating element is in the shape of a vessel of an arbitrary cross section, the height of said heating element being up to 5 meters, the wall thickness of a wall confining the bath up to 0.2 meters, and the surfaces of said heating element being in size up to 2 square meters.

12. Electric installation according to claim 1, wherein the heating element is in the shape of a partition of an arbitrary cross section, the thickness of the said heating element being up to 0.2 meters and the surfaces up to 2 square meters.

13. Electric installation according to claim 1, wherein the heating element is made of a homogonous material and is a unitary element.

14. Electric installation according to claim 1, wherein the surfaces of the heating element are partly covered with layers of material resistant to chemical action of the charge and contact materials.

15. Electric installation according to claim 1, wherein the heating element is saturated with materials diminishing the porosity of the material of the heating element.

16. Electric installation according to claim 1, wherein the heating element is arranged in the heated bath so as to freely float therein.

17. Electric installation according to claim 1, wherein the heating element is arranged in the heated bath so as to float therein, a weight being provided to keep the heating element in a forced immersion.

18. Electric installation according to claim 17, wherein the weight of the heating element is adapted to introduce a protective gas into said heating element.

19. Electric installation according to claim 17, wherein the weight of the heating element is provided with an additional resistance heater mounted in direct proximity to the edges of the heating element protruding from the bath and included in the electric circuit of the heating element.

20. Electric installation according to claim 1, wherein the heating element is partly immersed in the bath and mounted to a movable suspension for maintaining a steady immersion depth of said heating element at the varying level of the bath.

21. Electric installation according to claim 1, wherein the heating element is partly immersed in the bath and fixedly mounted to a support element.

22. Electric installation according to claim 1, wherein said second electrode is connected to one pole of a current source by means of said current supply means, and said first electrode is connected to the other pole of a current source by means of said current supply means.

23. Electric installation according to claim 1, wherein the supply voltage of the heating element is adjustable and the bath is earthed.

24. Electric installation according to claim 1, comprising an additional heater for starting said installation from its cold state when the charge is in solid form.

25. Electric installation according to claim 1, wherein the start from the cold state of the installation, when the charge is in solid form, is performed by said heating element placed on the charge, the surfaces of said heating element being in contact with the charge and electrodes by means of additional contact materials.

26. Electric installation according to claim 1, wherein the surfaces of said heating element are partly covered with layers of material of high electrical and thermal conductivity.

* * * * *